United States Patent [19]

Locke

[11] 4,081,902

[45] Apr. 4, 1978

[54] CUTTER HEAD ASSEMBLY FOR AN ELECTRIC DRY SHAVER

[75] Inventor: David Richard Locke, Bridgeport, Conn.

[73] Assignee: Sperry Rand Corporation, Bridgeport, Conn.

[21] Appl. No.: 748,611

[22] Filed: Dec. 7, 1976

[51] Int. Cl.[2] ..... B26B 19/04

[52] U.S. Cl. ..... 30/43.92; 30/346.51

[58] Field of Search ..... 30/34.1, 34.2, 43.91, 30/43.92, 346.51

[56] References Cited

U.S. PATENT DOCUMENTS

| | | | |
|---|---|---|---|
| 2,228,020 | 1/1941 | Testi | 30/43.92 X |
| 2,237,869 | 4/1941 | Rand | 30/43.92 |
| 2,240,264 | 4/1941 | Muros | 30/43.92 |
| 2,264,398 | 12/1941 | Murphy | 30/43.92 X |
| 2,395,495 | 2/1946 | Murphy | 30/43.92 X |

*Primary Examiner*—Gary L. Smith

*Attorney, Agent, or Firm*—Charles R. Miranda

[57] ABSTRACT

A cutter head assembly for an electric dry shaver including a cutter unit for shearing long facial or body hairs comprising an elongated U-shaped cutter member having a deep central longitudinally extending hair receiving channel. Combing teeth are provided along the upper edges of the channel for combing long hairs into longitudinal openings in the opposite sides of the channel for shearing by the teeth of a movable cutter and which teeth are maintained in cutting communication with the undersurface of the combing teeth.

12 Claims, 5 Drawing Figures

CUTTER HEAD ASSEMBLY FOR AN ELECTRIC DRY SHAVER

BACKGROUND OF THE INVENTION

The present invention is directed to new and useful improvements in a cutter head assembly for an electric dry shaver and in particular to a cutter head for shearing long facial or body hairs.

Electric dry shavers usually comprise a cutter head having a stationary outer cutter and an inner cutter mounted within the outer cutter for movement relative thereto. A plurality of hair reception slots are formed in the outer cutter for combing hair into the cutter head as the latter is manipulated across the surface of the skin of the user during a shaving operation. The inner cutter is provided with cutter teeth having cutting edges which shear the hair entering the slots against the edges of the outer cutter slots upon movement of the inner cutter. A problem common to electric dry shavers is the provision of efficient means for combing long facial or body hairs into position within the cutter head for shearing by the inner cutter. In cutter heads utilizing elongated outer cutters having reciprocating inner cutters, it is usual to provide rows of transverse hair reception slots in the outer cutter through which the hair is combed. The latter type cutter heads have proven effective for shearing upright short hair bristles, however, long hairs tend to lie flat against the surface of the skin and are further flattened by the cutter head as it is moved across the skin of the user requiring excessive manipulation to lift the hairs for combing into the cutter head.

In addition to the latter problems, it has been found that long hairs are also prevented from entering the cutter head by the bulging of the skin in advance of the cutter head preventing effective combing by the outer edges of the elongated outer cutter. In the past various devices such as combs or rollers have been provided on the shaver casing for stretching or tensioning the skin in advance of the cutter to enhance the combing effect of the outer cutter. Alternately the combing edges of the outer cutter have been spaced from the movable inner cutter and configurated to provide enlarged combing edges for lifting the hairs for entry into cutter head. In other prior art devices such as U.S. Pat. Nos. 2,264,398 and 2,395,495 it has been suggested to provide elongated cutter heads having a central longitudinally extending opening. The outer cutter of these devices are provided with cutter teeth at opposite sides of the opening for combing hair into the opening. These devices, however, are not concerned with the cutting of long hairs and contain guard means within the opening for preventing the skin from bulging into the opening and inadvertently engaging the movable inner cutter.

It is an object of the present invention to provide a novel cutter head for an electric dry shaver.

Another object is to provide a novel cutter head having novel combing action for shearing long facial or body hair with minimum irritation to the skin of the user.

Another object is to provide a cutter head for shearing long hairs having means for tensioning or stretching the skin in advance of the cutting means for feeding long hairs into the path thereof.

A still further object is to provide a novel electric dry shaver having a multiple cutter head for cutting both long and short hairs of the user.

SUMMARY OF THE INVENTION

The present invention contemplates a novel cutter head assembly for an electric dry shaver. In one embodiment, the cutter head comprises an elongated movable cutter and a stationary cutter. The stationary cutter comprises a rectangular shaped tubular member having an upper cutting portion comprised of two rows of spaced combing teeth arranged at opposite sides of an open longitudinal channel in the stationary cutter. The movable cutter includes an elongated U-shaped member having cutter teeth provided on a pair of spaced arms thereof in shearing contact with the undersurface of the stationary cutter combing teeth. In use the surface of one of the rows of combing teeth stretch the skin in the direction perpendicular to the movement of the movable cutter to comb long hairs into the channel in the stationary cutter for entry into one of the open sides of the channel for shearing by the movable cutter.

The above and other objects and advantages of the present invention will appear more fully hereinafter in consideration of the detailed description which follows taken together with the accompanying drawing wherein an embodiment of the invention is illustrated.

DETAILED DESCRIPTION

Figure 1:
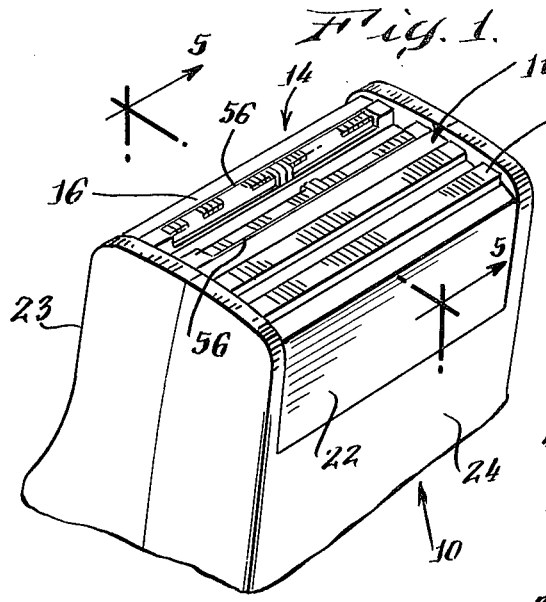
FIG. 1 is a fragmentary perspective view of the upper portion of an electric shaver having a cutter head assembly having a cutter unit incorporating the present invention.
Figure 4:
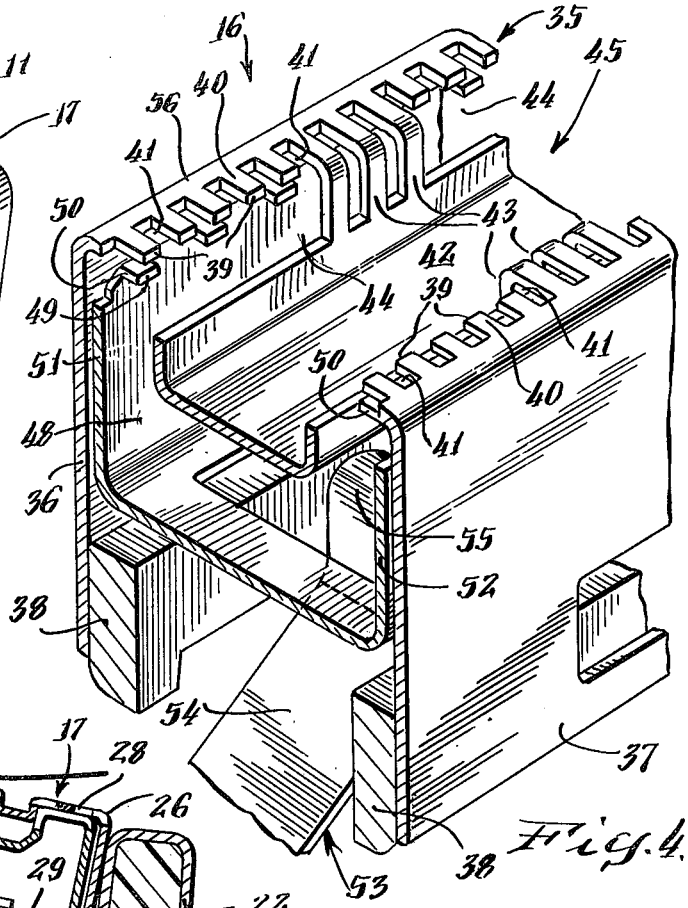
FIG. 4 is an enlarged perspective view taken on the line 4—4 of FIG. 3.
Figure 3:
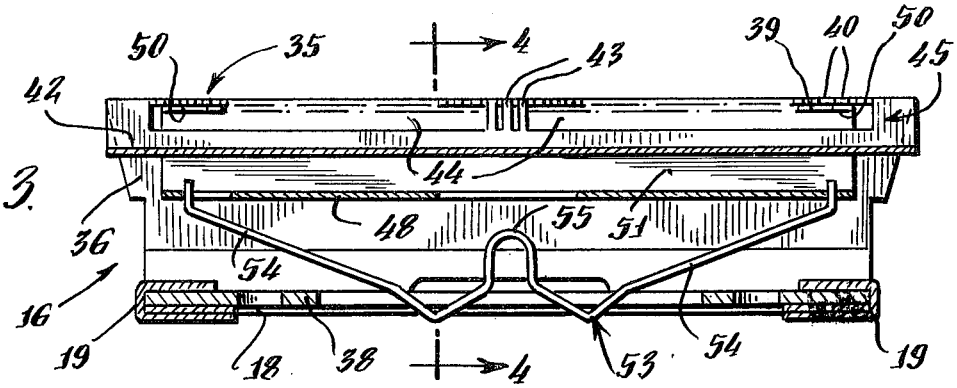
FIG. 3 is a sectional view taken on the line 3—3 of FIG. 2.

Referring now to the drawings for a more detailed description of the present invention, an upper portion of an electric dry shaver generally indicated by the reference numeral 10 is shown in FIG. 1. Electric dry shaver 10 is of a usual construction and includes a cutter head receptacle 11 provided in the upper portion thereof in which is disposed a cutter head assembly 14. Cutter head assembly 14 includes a long hair cutter unit 16 and a short hair cutter unit 17 mounted on a support plate 18 in a usual manner as for example by clips 19 (as shown in FIG. 3 with respect to cutter unit 16). Integrally formed support plate clamping portions 21 and 22 (FIG. 5) secure support plate 18 to spaced sidewalls 23 and 24 of the cutter head receptacle 11 of shaver 10.

The short hair cutter unit 17 is of a known construction and is adaptable for shearing short hair bristles fed thereto. Cutter unit 17 includes an elongated inverted U-shaped outer cutter 26 having opposite wall portions secured to a U-shaped base spacer 27. The flat upper surfaces of outer cutter 26 are provided with a plurality of hair reception slots 28 which extend into opposed depending wall portions of outer cutter 26 for feeding hair into cutting relationship with a movable inner cutter 29 of a type generally disclosed in U.S. Pat. No. 2,793,430 to L. C. Carissimi dated May 28, 1957. Inner cutter 29 of cutter unit 17 comprises an elongated tubular member substantially rectangular in cross section having cutter teeth 30. Inner cutter 29 is maintained in cutting cooperation with the undersurface of outer cutter 26 by means of a leaf spring 31 (partially shown in FIG. 5). Leaf spring 31 has a central portion 32 seated on a drive arm 33 of a motor (not shown) housed in a suitable manner in electric shaver 10 and which drive arm 33 is adapted to move inner cutter 29 in a reciprocating path within outer cutter 26 upon operation of the shaver motor.

As mentioned, it is a feature of this invention to provide a novel cutter head for cutting long facial or body hairs. To this end, long hair cutter unit 16 is provided with an elongated stationary outer cutter 35 comprising an inverted U-shaped cutter member having lower marginal portions of opposed depending sidewalls 36 and 37 secured to the walls of a U-shaped base spacer 38 as by spot welding. The bight portion of stationary cutter 35 is provided with spaced rows of opposed combing teeth 40 and open slots 41 adjacent thereto, with combing teeth 40 terminating at leading edges 39. The rows of combing teeth 40 project toward each other from flat ledges 56 which are formed in the same plane as the combing teeth 40. Ledges 56 are co-extensive and integral with the depending sidewalls 36 and 37 of stationary cutter 35.

The two rows of combing teeth 40 are spaced one from the other by a deep longitudinally extending channel 45. A central member 42 forms a base or bottom wall of channel 45 and is formed integral with the bight portion of stationary cutter 35 at opposed distal ends thereof. The central member 42 is integrally interconnected to combing teeth 40 at spaced intervals along the length thereof by extended teeth portions 43. The central member 42 is otherwise spaced from combing teeth 40 by longitudinally extending wall portions 59 provided with hair reception opening 44 along the length thereof within the longitudinal channel 45. The central member 42 serves to strengthen stationary cutter 35 by tying the spaced rows of combing teeth 40 thereby utilizing a thinner gauge material in the fabrication of stationary cutter 35. The central member 42 also serves as a catch basin for clipped hair ends.

Stationary cutter 35 is provided with a movable long hair inner cutter 48 which includes a U-shaped cutter member having cutter teeth 50 and open slots 47 adjacent thereto extending from the upper edges of the spaced arms 51–52 of movable cutter 48. Cutter teeth 50 terminate at edges 49 and which edge 49 are recessed with respect to leading edges 39 of combing teeth 40. The recessing of edges 49 allows space for entry of hair engaged by the leading edges 39 to enter the slots 41 prior to contact by movable cutter teeth 50. Teeth 50 are maintained in cutting engagement with the undersurface of combing teeth 40 of stationary cutter 35 by a leaf spring 53. Arms 54 of leaf spring 53 are interconnected to the ends of movable cutter 48 in a known manner to urge movable cutter 48 into shearing relationship with combing teeth 40 when central portion 55 of leaf spring 53 is seated on motor drive arm 58 in the manner described in the mentioned U.S. Pat. No. 2,793,430.

Figure 5:
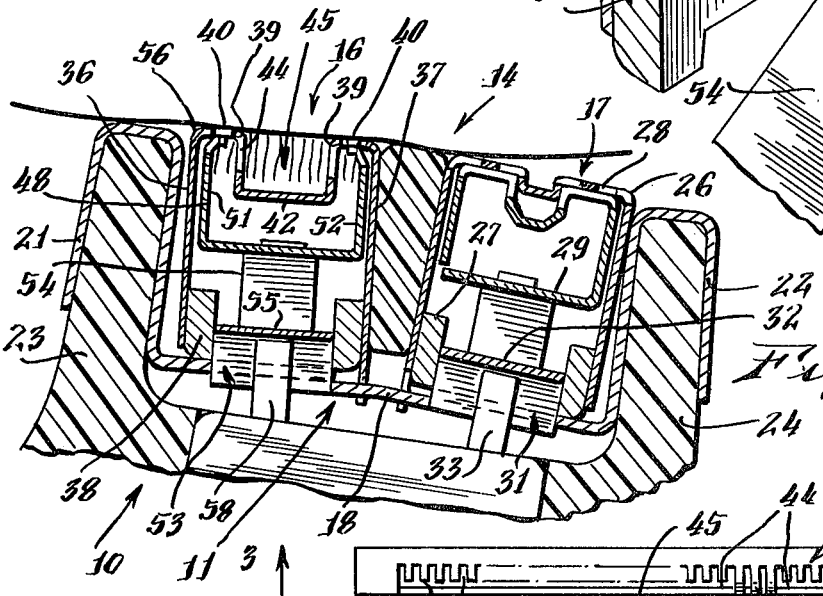
FIG. 5 is a sectional view through the cutter head assembly taken on the line 5—5 of FIG. 1.
Figure 2:
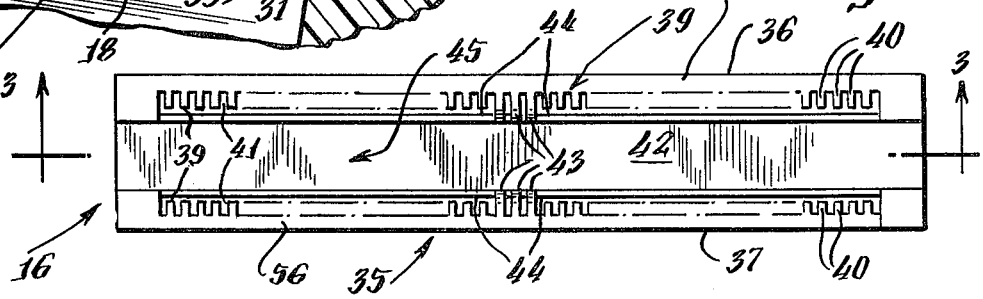
FIG. 2 is a plan view of the cutter unit removed from the shaver.

As a result of the described arrangement in use of shaver 10 long hairs (as illustrated in FIG. 5) are fed into the channel 45 of the stationary cutter 35 by combing teeth 40 and then sequentially into the longitudinal openings 44 which are in open communication with slots 41 of combing teeth 40 and into slots 47 of movable cutter teeth 50. It has been found, in use, that as cutter unit 16 is moved across the skin during a cutting stroke, the uppper surfaces of the ledges 56 and combing teeth 40 will stretch and tension the skin to prevent the skin from entering hair receiving channel 45 thereby allowing leading edges 39 of combing teeth 40 to readily lift long hairs and comb the same into channel 45 for upright feeding into openings 44, slots 41 of combing teeth 40 and slots 47 of movable cutter 48.

It will be apparent from the foregoing description that the novel cutter unit has many advantages in use. One advantage among others is that novel means are provided in the cutter head for lifting and feeding long hairs thereto and for stretching the skin to prevent the skin from bulging into the path of the movable inner cutter. Another advantage is the provision of a long hair shearing unit for inclusion with a short hair shearing unit resulting in a dual purpose cutter head assembly.

It is to be understood that the present invention is not limited to the embodiments illustrated and described. Various changes can be made in the design and arrangement of parts without departing from the spirit and scope of the invention as the same will now be understood by those skilled in the art.

I claim:

1. A cutter head for an electric dry shaver having motor driven cutter drive means, said cutter head comprising, a. a hollow rectangular-shaped elongate stationary cutter, said stationary cutter having opposed sidewalls depending from a pair of spaced opposed ledges formed along the length of said stationary cutter, said ledges having continuous coplanar surfaces adjacent each of said sidewalls, b. a movable inner cutter mounted within said stationary cutter in hair shearing relationship with said stationary cutter, c. a plurality of hair combing teeth formed in at least one of said ledges with the individual teeth extending transversely of the stationary cutter and terminating in leading edges, said teeth having surface portions formed on the same plane as said continuous coplanar surfaces of the ledges, d. a rectangular-shaped hair receiving opening formed in said stationary cutter extending longitudinal thereof between said ledges and arranged adjacent said leading edges of the hair combing teeth, and e. said opening forming a passage into the interior of said stationary cutter for entry of hair combed into said opening by said teeth for engagement with said movable inner cutter, said continuous coplanar surfaces of the ledges cooperating to stretch the skin in advance of the movable inner cutter.

2. The cutter head of claim 1 wherein said stationary cutter is of an elongated inverted U-shaped configuration having a bight portion and wherein said hair receiving opening comprises a deep channel having a base formed from the bight portion of said stationary cutter.

3. The cutter head of claim 2 wherein said base comprises a longitudinal extending strengthening member depending from opposed ends of said bight portion.

4. The cutter head of claim 3 wherein said channel comprise wall portions having elongated longitudinal openings formed therein between said base and the combing teeth to provide said passage to the interior of the stationary cutter.

5. The cutter head of claim 4 wherein said combing teeth comprise a pair of spaced rows of teeth in said bight portion, said rows of teeth being spaced from each other at opposite sides of said channel, said rows of combing teeth each having skin engaging surfaces lying in the same plane as said continuous coplanar surfaces of said ledges to stretch the skin and prevent entry thereof into said channel.

6. The cutter head of claim 5 wherein the movable cutter is provided with arms having teeth extending therefrom, said teeth arranged in cutting relationship with the undersurfaces of said combing teeth.

7. In an electric shaver having a casing, a motor driven cutter drive means and a cutter head disposed in said casing, said cutter head including an elongated inverted U-shaped stationary cutter member, a movable inner cutter mounted within said cutter member in hair shearing engagement therewith and operable by the drive means, said cutter member comprising, a. an elongated bight portion having a width defined by a pair of spaced longitudinally extending opposed sidewalls depending from and formed perpendicular to said bight portion, b. longitudinally extending ledges having continuous coplanar surfaces formed from said bight portion coextensive with said sidewalls, c. an elongated hair receiving opening formed in said bight portion and extending longitudinally of said cutter member, said opening occupying a substantial portion of the width of said bight portion, said opening forming a passage into the interior of said cutter member, d. a plurality of hair combing teeth formed in said ledges extending in the direction of said opening, said teeth terminating in leading edges adjacent said opening, and e. said teeth each having skin engaging surfaces formed on the same plane as the continuous coplanar surfaces of said ledges for stretching the skin in advance of the movable inner cutter, said teeth combing hair into said opening for passage into shearing engagement with the movable inner cutter.

8. The cutter member of claim 7 wherein an intermediate portion of said opening is spanned by a segment of said bight portion.

9. The cutter member of claim 7 wherein said opening is formed by an elongated channel extending longitudinally of said cutter member, said channel having a bottom wall formed integral with said bight portion, said bottom wall being spaced from the leading edges of said teeth to provide longitudinal openings in the side of said channel to provide said passage for entry of hair combed into said channel to said movable inner cutter.

10. The cutter member of claim 9 wherein said channel is provided with wall portions formed integral with said bottom wall and said bight portion at opposite ends of said channel, said wall portions having longitudinally extending openings formed therein between said bottom wall and said leading edges of the teeth to form said passage to said movable inner cutter.

11. The cutter member of claim 10 wherein an intermediate section of said wall portions is interconnected to said bight portion by extended portions of said teeth.

12. The cutter member of claim 11 wherein spaced groups of teeth interconnect said intermediate section of the wall portions.

* * * * *